US006219995B1

(12) United States Patent
Boldrini et al.

(10) Patent No.: US 6,219,995 B1
(45) Date of Patent: Apr. 24, 2001

(54) PACKAGING MACHINE

(75) Inventors: Fulvio Boldrini, Ferrara; Giovanni Allocca, Bologna; Alessandro Venturoli, Granarolo Dell'Emilia, all of (IT)

(73) Assignee: G.D S.p.A., Bologna (IT)

( * ) Notice: Subject to any disclaimer, the term of this patent is extended or adjusted under 35 U.S.C. 154(b) by 0 days.

(21) Appl. No.: 09/343,476

(22) Filed: Jun. 30, 1999

(30) Foreign Application Priority Data

Jul. 6, 1998 (IT) ..... BO98A0412

(51) Int. Cl.[7] ..... B65B 49/00

(52) U.S. Cl. ..... 53/234; 53/225; 53/228; 53/466

(58) Field of Search ..... 53/234, 225, 233, 53/228, 466

(56) References Cited

U.S. PATENT DOCUMENTS

| | | | | |
|---|---|---|---|---|
| 4,358,920 | * | 11/1982 | Kanai et al. | 53/234 |
| 4,617,780 | * | 10/1986 | Focke et al. | 53/466 |
| 4,918,901 | | 4/1990 | Gamberini et al. | 53/234 |
| 5,457,932 | * | 10/1995 | Spada et al. | 53/234 |

FOREIGN PATENT DOCUMENTS

| | | | | |
|---|---|---|---|---|
| 25 26 047 | | 1/1976 | (DE) . | |
| 519 402 A1 | * | 12/1992 | (EP) | 53/234 |
| 0 642 975 | | 3/1995 | (EP) . | |
| 1 086 180 | | 10/1967 | (GB) . | |

* cited by examiner

*Primary Examiner*—Stephen F. Gerrity
*Assistant Examiner*—Sam Tawfik
(74) *Attorney, Agent, or Firm*—Pillsbury Winthrop LLP

(57) ABSTRACT

In a packaging machine that includes a wrapping wheel equipped with at least one conveying head affording a seat capable of movement with the wrapping wheel along a looped path, the head is indexed through a first station at which the seat receives a product, a second station where a wrapping sheet is taken up and held stably by a gripper mechanism across an opening of the seat, in a predetermined position, and an outfeed station at which the product is ejected from the seat and caused to associate with the wrapping sheet, whereupon product and sheet are transferred together to a further wrapping wheel; the machine is equipped with a device located externally of the wrapping wheel by means of which to actuate the gripper mechanism.

16 Claims, 3 Drawing Sheets

PACKAGING MACHINE

BACKGROUND OF THE INVENTION

The present invention relates to a packaging machine.

Explicit reference will be made in the following specification to the field of packaging machines for manufacturing packets of cigarettes, albeit no limitation is implied.

Packaging machines embraced by the prior art, as disclosed for example in U.S. Pat. No. 4,918,901, comprise a wrapping wheel equipped with a plurality of conveying heads each affording a first seat, of which the function is to admit and retain a product for wrapping, and a second seat serving to admit and retain a respective sheet of wrapping material held in a predetermined position across an opening presented by the first seat through the agency of a pair of vacuum type gripping elements located one on either side of the opening and operated by means of a control device mounted to the wrapping wheel in a central position.

In operation the wrapping wheel is made to rotate intermittently about a fixed central axis in such a way as to index the conveying head through a first infeed station, at which the product is directed into the first seat, then a second infeed station at which the wrapping sheet is taken up into the second seat, and finally an outfeed station where the product is ejected from the first seat in such a way as to associate with the wrapping sheet, and transferred together with the sheet to a further wrapping wheel.

Packaging machines of the type outlined above are somewhat costly inasmuch as the wrapping wheel must carry both the gripping elements and the relative control device, and tends as a result to be complex in design and construction.

The object of the present invention is to provide a packaging machine free from the drawback outlined above, and therefore simple and economical to carry into effect.

SUMMARY OF THE INVENTION

The stated object is realized according to the invention in a packaging machine that incorporates a conveying head; a first seat afforded by the conveying head, presenting an opening and serving to receive a product; a second seat afforded by the conveying head, positioned to coincide with the opening of the first seat and serving to receive a wrapping sheet; gripper means by which a relative wrapping sheet is held in contact with the second seat; actuator means operating the gripper means; a conveyor by which the conveying head is advanced along a wrapping path; also a first infeed station located along the wrapping path, at which a product is taken up by the first seat; a second infeed station located along the wrapping path at which a wrapping sheet is taken up by the second seat; and ejector means by which a product is distanced from the conveying head and transferred together with a respective wrapping sheet to external conveying means.

To advantage, in the packaging machine disclosed, the actuator means are positioned externally of the conveyor.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
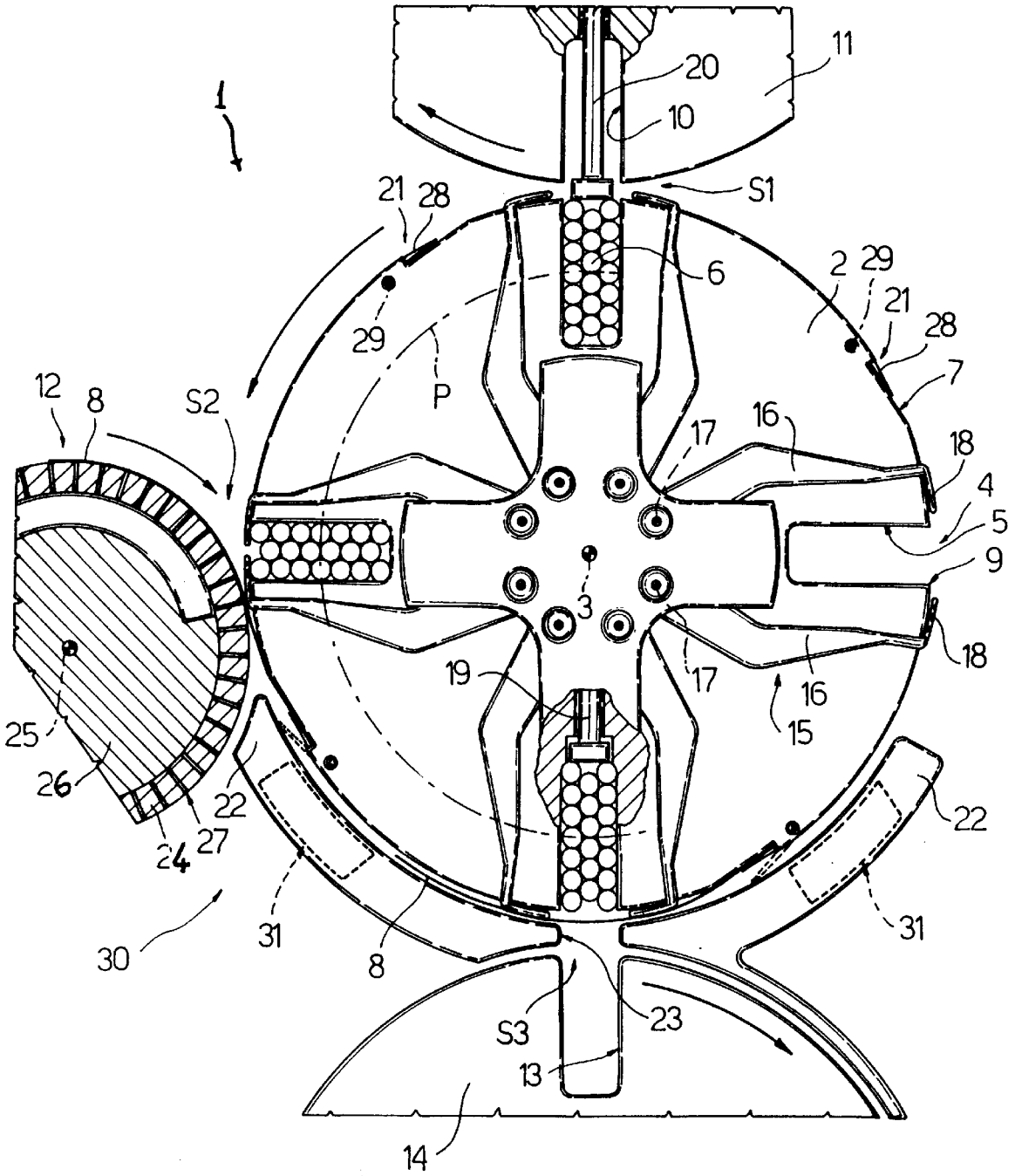
FIG. 1 is a schematic elevation showing a preferred embodiment of a packaging machine according to the present invention, illustrated partly in section and with certain parts omitted for clarity.

Referring to FIG. 1 of the drawings, 1 denotes a cigarette packaging machine, in its entirety, which comprises a power driven wrapping wheel 2 indexable about an axis 3 of rotation perpendicular to the viewing plane of FIG. 1 and carrying four peripheral conveying heads 4 equispaced around the axis 3. Each head 4 incorporates a first seat 5 designed to admit and retain a group 6 of cigarettes, disposed radially to the axis 3 of rotation, also a second seat 7 extending along the periphery of the wheel 2 and associated with the first seat 5, designed to receive and retain a sheet 8 of wrapping material in a position tangential to the periphery of the wheel and straddling an opening 9 afforded by the first seat 5.

The single head 4 is made by the rotation of the wheel 2 to advance along a path, denoted P, through a first infeed station S1 at which the first seat 5 receives a group 6 of cigarettes from a seat 10 of a conventional power driven feed wheel 11 rotatable about an axis (not indicated) lying parallel to the axis 3 of the wheel 2. The head 4 is also made to advance through a second infeed station S2, where the second seat 7 receives a sheet 8 of wrapping material from a feed unit 12, and finally through an outfeed station denoted S3 at which the group 6 of cigarettes is ejected from the head 4 in such a manner that it will be associated and transferred together with the wrapping sheet 8 into a seat 13 afforded by another power driven wrapping wheel 14 of conventional embodiment indexed about an axis (not indicated) extending parallel to the axis 3 of rotation.

Each of the heads 4 comprises a gripper device 15 associated with the corresponding first seat 5 and serving to retain a relative group 6 of cigarettes internally of the selfsame seat, thus counteracting the centrifugal force generated by the rotation of the wheel 2. The gripper device 15 includes two jaws 16 pivotable about respective axes 17 disposed parallel to the axis 3 of the wheel 2 and capable thus of movement, brought about by a cam mechanism (not indicated, being of conventional embodiment), toward and away from a gripping position in which the opening 9 of the relative seat 5 is partially occluded by two profiles 18 at the extremities of the two jaws 16.

Also forming a part of each conveying head 4 is a push rod 19 of familiar embodiment operated by a conventional cam mechanism (not illustrated) and capable of movement through the respective first seat 5 in concert with a corresponding push rod 20 associated with the seat 10 of the feed wheel 11, by which a group 6 of cigarettes is transferred from the feed wheel seat 10 to the wrapping wheel seat 5 opposite, and with a corresponding push rod (not illustrated) associated with the seat 13 of the wheel 14 next in sequence, so as to transfer a group 6 of cigarettes from the one seat 5 to the adjacent seat 13.

Lastly, each head 4 comprises a gripper device 21 associated with the respective second seat 7 and serving to retain a relative wrapping sheet 8 in contact with the seat 7, occupying a predetermined position, thus counteracting the centrifugal force generated by the rotation of the wheel 2.

In order to keep each successive wrapping sheet 8 breasted in contact with the relative seat 7 during the movement of the head 4 from the second infeed station S2 to the outfeed station S3, the machine 1 comprises a pair of restraints 22 disposed facing and parallel to the periphery of the wheel 2 and combining to create an opening 23, located at the outfeed station S3, through which the group 6 of cigarettes is transferred from the first seat 5 to the seat 13 of the adjacent wheel.

The feed unit 12 is a conventional feed mechanism comprising an outer power driven wheel 24 set in rotation about a fixed axis 25, extending parallel to the axis 3 of the wheel 2, and about a fixed inner wheel 26 functioning as the valve element for a pneumatic system by which a negative pressure is generated through a plurality of holes 27 in the outer wheel 24 so as to retain a wrapping sheet 8 in contact with the surface of this same wheel 24.

Each gripper device 21 comprises a single clip 28 located on the part of the relative second seat 7 disposed forwardmost in the feed direction, hence to one side of the respective opening 9.

Each clip 28 is mounted pivotably to the wheel 2 and made to oscillate about an axis 29 parallel to the axis 3 of rotation, by means of an actuator device 30, between a position of disengagement (indicated by phantom lines in FIG. 1) in which a relative wrapping sheet 8 is received or released, and a position of engagement (indicated by solid lines in FIG. 1) in which the wrapping sheet 8 is held in contact with the second seat 7.

The actuator device 30 comprises a pair of single actuators 31 serving to operate the clip 28, which are entirely similar and located externally of the wrapping wheel 2 occupying fixed positions relative to the machine 1 at the second infeed station S2 and the outfeed station S3 respectively.

Each actuator 31 is designed to bring about the movement of a single clip 28 from the position of engagement to the position of disengagement against the action of a relative bias spring 32, by which the clip 28 is maintained normally in the position of engagement with a predetermined force.

Figure 2:
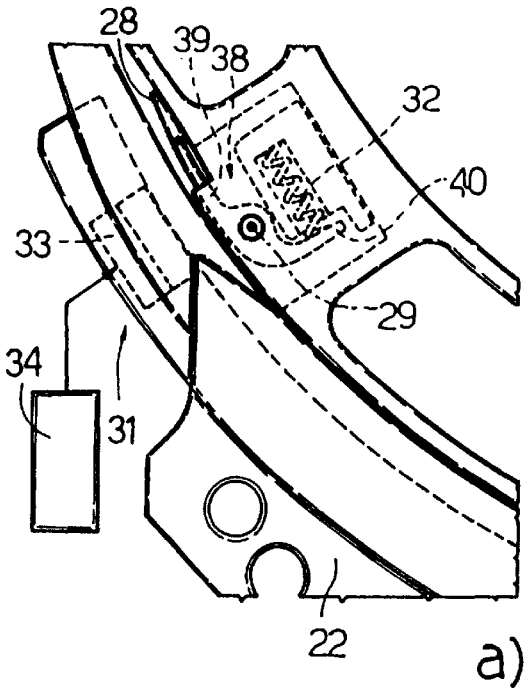
FIG. 2 shows a detail of FIG. 1, enlarged and in two different operating configurations.
Figure 2:
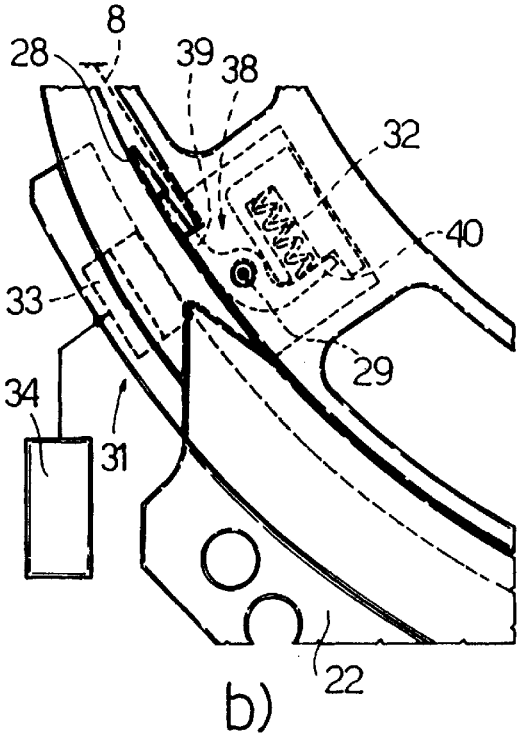

In the example of FIG. 2, each clip 28 is embodied in a ferromagnetic material, and each actuator 31 comprises an electromagnet, denoted 33, of which the operation is piloted by a control device 34 in such a way that the creation of a magnetic field will attract the clip 28 and cause it to assume the position of disengagement, opposing the action of the spring 32.

Figure 3:
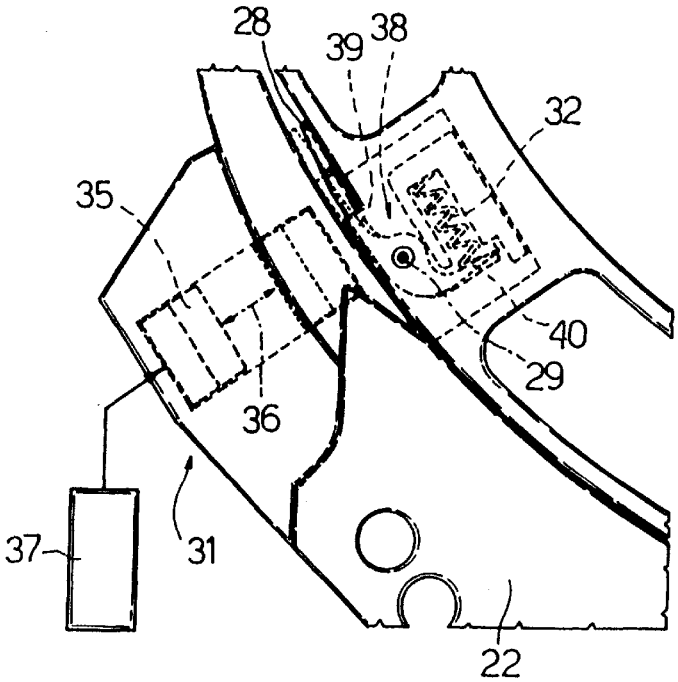
FIG. 3 shows the detail of FIG. 2 in an alternative embodiment.

In the example of FIG. 3, each clip 28 is embodied in a ferromagnetic material, and each actuator 31 comprises a permanent magnet, denoted 35, mounted slidably and capable of movement in a direction 36 normal to the wrapping path P, brought about by a relative control device 37, toward and away from an operating position of close proximity to a clip 28, in which the clip is attracted and caused to assume the position of disengagement, opposing the action of the spring 32.

In the embodiments of FIGS. 2 and 3, each gripper device 21 comprises a rocker 38, mounted pivotably to the wheel 2 and able thus to oscillate about the relative axis 29, of which one arm 39 functions as the movable clip 28 and another arm 40 is connected mechanically to the relative spring 32.

Figure 4:
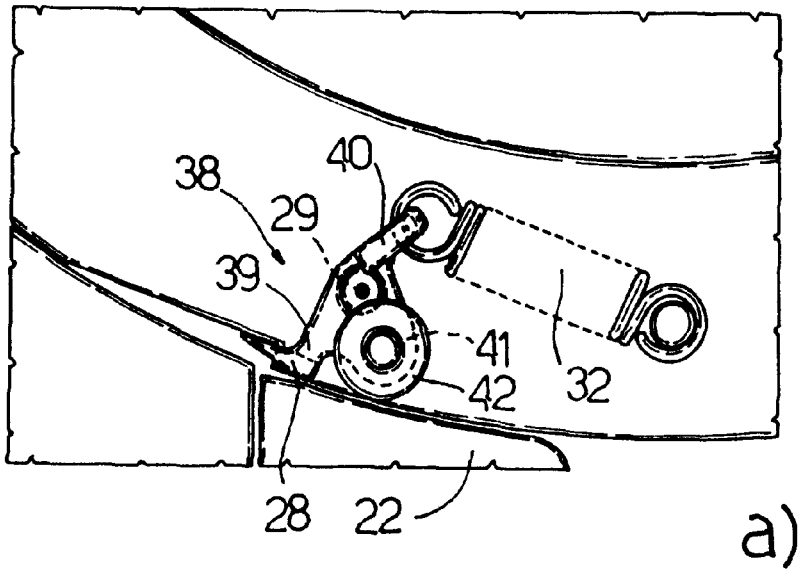
FIG. 4 shows a further embodiment of the detail of FIG. 2 in two different operating configurations.
Figure 4:
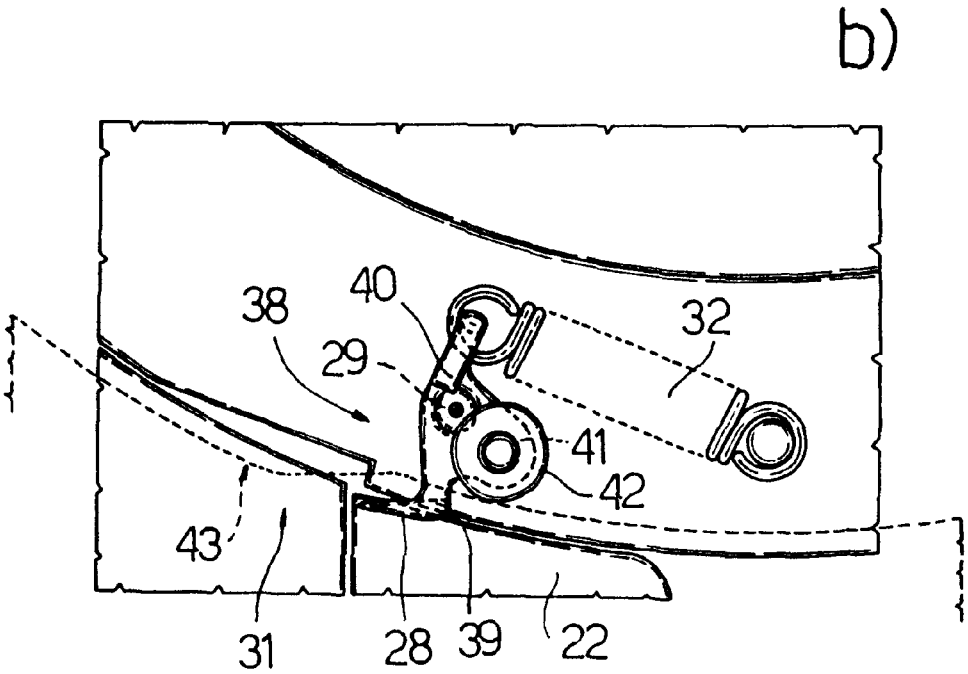

In the example of FIG. 4, each gripper device 21 again comprises a rocker 38, mounted pivotably to the wheel 2 and able thus to oscillate about the relative axis 29, of which a first arm 39 provides the movable clip 28, a second arm 40 is connected mechanically to the spring 32 and a third arm 41 carries a cam follower 42 consisting in a roller that can be operated in such a manner as to shift the clip 28 from the position of engagement to the position of disengagement.

Still referring to FIG. 4, the single actuator 31 comprises a fixed cam profile 43 which operates in conjunction with each individual roller 42 in such a way as to shift the relative clip 28 toward the position of disengagement against the action of the spring 32.

In a further embodiment, not illustrated in the accompanying drawings, the actuator 31 associated with the second infeed station S2 might include a pushing element carried by the wheel 24 of the feed unit 12 and operating in conjunction with each roller 42 in such a manner as to shift the relative clip 28 into the position of disengagement against the action of the spring 32.

Referring to FIG. 1, the operation of the machine will now be described following the movements of a single conveying head 4, beginning from the moment when the head 4 is brought into the first infeed station S1 by the rotation of the wheel 2.

At this first station S1, a group 6 of cigarettes is transferred to the first seat 5 of the head 4 in familiar manner, whereupon the wheel 2 rotates 90° (counterclockwise as seen in FIG. 1) to advance the head toward the second infeed station S2. During the first part of the movement toward the second station S2 the jaws 16 assume the gripping position in order to retain the group 6 of cigarettes in the seat 5.

As the head 4 reaches the station S2 the relative actuator 31 will cause the leading clip 28 to pivot away from the position of engagement and toward the position of disengagement, so that the seat 7 can receive a corresponding wrapping sheet 8 from the feed unit 12 in familiar manner.

Once the sheet 8 has been taken up by the seat 7, the first actuator 31 changes state and the clip 28 is returned by the action of the spring 32 to the position of engagement, pinning the sheet 8 in a predetermined position relative to the seat 7. The head 4 then rotates a further 90° (counterclockwise in FIG. 1) toward the outfeed station S3. As the head 4 draws into alignment with the station S3 the second actuator 31 changes state and the clip 28 is made to shift away from the position of engagement to the position of disengagement, thus allowing the sheet 8 to be removed from the seat 7 when invested by the group 6 of cigarettes directed toward the seat 13 of the adjacent wheel 14 by the action of the push rod 19.

Once the group 6 has been transferred from the one seat 5 to the other seat 13, the actuator 31 again changes state and the clip 28 is returned to the position of engagement by the spring 32. Finally, the wheel 2 rotates 180° (counterclockwise in FIG. 1) to return the head 4 to the first infeed station S1 and the sequence of steps described thus far will be repeated for a successive group 6 of cigarettes and a successive wrapping sheet 8.

What is claimed is:

1. A packaging machine, comprising:

a conveying head;

a first seat portion of the conveying head presenting an opening and serving to receive a product;

a second seat portion of the conveying head, positioned to coincide with the opening of the first seat and serving to receive a wrapping sheet;

a gripper disposed on the conveying head and constructed and arranged to hold a wrapping sheet in contact with the second seat;

an actuator constructed and arranged to operate the gripper;

a conveyor by which the conveying head is advanced along a wrapping path;

a first infeed station located along the wrapping path; at which a product is fed to the first seat;

a second infeed station located along the wrapping path at which a wrapping sheet is fed to the second seat; and an ejector constructed and arranged to eject a product from the conveying head and to transfer the product, together with a respective wrapping sheet to external conveying means, wherein the actuator means are positioned externally of the conveying head and do not move therewith.

2. A packaging machine as in claim 1, wherein the gripper further comprises a clip disposed on one side of the opening and capable of movement away from and toward a holding position in which a wrapping sheet is held in contact with the second seat by the clip.

3. A packaging machine as in claim 2, wherein the clip comprises at least one portion comprising a ferromagnetic material, and the actuator comprises at least one device disposed in a fixed position relative to the machine, which is constructed and arranged to generate a magnetic field acting on the ferromagnetic portion of of the clip to operate the clip.

4. A packaging machine as in claim 3, wherein the at least one device is positioned at the second infeed station.

5. A packaging machine as in claim 3, wherein the generating device comprises an electromagnet.

6. A packaging machine as in claim 3, wherein the generating device comprises a permanent magnet mounted slidably and capable of movement in a direction perpendicular to the wrapping path away from and toward an operating position of close proximity to the conveyor.

7. A packaging machine as in claim 2, wherein the clip is mounted pivotably to the conveyor and able to pivot away from and toward the holding position.

8. A packaging machine as in claim 2, wherein the gripper comprises a transmission component enabled to be operated to shift the clip away from and toward the holding position, and the actuator comprises at least one pushing device disposed externally of the conveyor, constructed and arranged to interact with the transmission component when in operation.

9. A packaging machine as in claim 8, wherein the pushing device comprises a profile carried by a feed unit positioned at the second infeed station and supplying the wrapping sheets.

10. A packaging machine as in claim 9, wherein the actuator further comprises a fixed pushing device affording a profile, which occupies a fixed position in relation to the machine.

11. A packaging machine as in claim 8, wherein the clip is mounted pivotably to the conveyor and enabled to pivot away from and toward the holding position.

12. A packaging machine as in claim 11, wherein the gripper comprises a spring by which the clip is biased towards the holding position.

13. A packaging machine as in claim 12, wherein the gripper comprises a rocker mounted pivotably to the conveyor, a first arm of the rocker comprising the movable clip and a second arm of the rocker being connected mechanically to the spring and a third arm of the rocker supports the transmission component.

14. A packaging machine as in claim 1, wherein the gripper comprises a spring by which the clip is hinged towards the holding position.

15. A packaging machine as in claim 14, wherein the gripper comprises a rocker mounted pivotably to the conveyor, a first arm of the rocker comprising the movable clip and, a second arm of the rocker being connected mechanically to the spring.

16. A packaging machine as in claim 1, wherein the conveyor comprises a power driven wrapping wheel rotatable intermittently about a fixed central axis.

* * * * *